US009547251B2

(12) United States Patent
Suzuki et al.

(10) Patent No.: US 9,547,251 B2
(45) Date of Patent: Jan. 17, 2017

(54) IMAGE FORMING APPARATUS HAVING CONTROLLABLE POTENTIAL DIFFERENCE

(75) Inventors: Shinya Suzuki, Abiko (JP); Tadashi Fukuda, Toride (JP); Takuya Hori, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 127 days.

(21) Appl. No.: 13/281,922

(22) Filed: Oct. 26, 2011

(65) Prior Publication Data

US 2012/0114348 A1 May 10, 2012

(30) Foreign Application Priority Data

Nov. 4, 2010 (JP) ..... 2010-247861

(51) Int. Cl.

| | |
|---|---|
| ***G03G 15/00*** | (2006.01) |
| ***G03G 15/02*** | (2006.01) |
| ***G03G 15/09*** | (2006.01) |
| ***G03G 15/06*** | (2006.01) |

(52) U.S. Cl.

CPC ..... *G03G 15/0266* (2013.01); *G03G 15/065* (2013.01); *G03G 15/09* (2013.01); *G03G 15/553* (2013.01); *G03G 2215/0609* (2013.01)

(58) Field of Classification Search

CPC .. G03G 15/0266; G03G 15/09; G03G 15/553; G03G 15/065; G03G 2215/0607–2215/0909

USPC ..... 399/25, 53, 55, 267, 270

See application file for complete search history.

(56) References Cited

U.S. PATENT DOCUMENTS

| | | | | |
|---|---|---|---|---|
| 5,235,384 | A * | 8/1993 | Oka et al. | |
| 7,734,200 | B2 * | 6/2010 | Sugiyama et al. | 399/25 |
| 2006/0034627 | A1 * | 2/2006 | Kikuchi et al. | 399/25 |
| 2009/0202263 | A1 * | 8/2009 | Yoshida et al. | 399/55 |

(Continued)

FOREIGN PATENT DOCUMENTS

| | | |
|---|---|---|
| JP | 07-175282 A | 7/1995 |
| JP | 7-175321 A | 7/1995 |

(Continued)

OTHER PUBLICATIONS

Official translation of Image Forming Device (JP Pub.2007-065095), Seiji Yamada.*

*Primary Examiner* — David Gray
*Assistant Examiner* — Laura Roth
(74) *Attorney, Agent, or Firm* — Canon USA, Inc. IP Division

(57) ABSTRACT

An image forming apparatus is disclosed. The image forming apparatus includes an image bearing member, a developing device, a gap retaining member and a control unit. The control unit decreases a potential difference according to an increase in the drive amounts of the image bearing member and the developer bearing member. The decrease is based on a difference according to an increase in at least one of the drive amounts of the image bearing member and the developer bearing member. The control unit is also configured to determine whether to execute a mode based on information about at least one of the driving amounts of the image bearing member and the developer bearing member from when the developing device is initially installed or the developing device is replaced.

2 Claims, 17 Drawing Sheets

(56) References Cited

U.S. PATENT DOCUMENTS

| | | | | |
|---|---|---|---|---|
| 2009/0257763 | A1* | 10/2009 | Hayashi | 399/53 |
| 2010/0266301 | A1* | 10/2010 | Ohshika | 399/55 |
| 2010/0303486 | A1* | 12/2010 | Shibata et al. | 399/55 |
| 2011/0142512 | A1* | 6/2011 | Sakurai | G03G 15/0813 399/345 |

FOREIGN PATENT DOCUMENTS

| | | | | | |
|---|---|---|---|---|---|
| JP | 10-207224 | A | | 8/1998 | |
| JP | 2001-109340 | A | | 4/2001 | |
| JP | 2001-140857 | A | | 5/2001 | |
| JP | 2002-296903 | A | | 10/2002 | |
| JP | 2002296903 | A | * | 10/2002 | G03G 15/08 |
| JP | 2004-163478 | A | | 6/2004 | |
| JP | 2007065095 | A | * | 3/2007 | |

* cited by examiner

BLANK PORTION

SOLID PORTION

IMAGE FORMING APPARATUS HAVING CONTROLLABLE POTENTIAL DIFFERENCE

BACKGROUND OF THE INVENTION

Field of the Invention

The present invention relates to an image forming apparatus employing an electrophotographic method or an electrostatic recording method. In particular, the present invention relates to an image forming apparatus such as a copying machine, a printer, or a facsimile, which includes a retaining member that retains a gap between an image bearing member and a developer bearing member.

Description of the Related Art

Conventionally, an image forming apparatus such as a copying machine, a printer, or a facsimile using an electrophotographic method includes a developing sleeve disposed in a position opposing a photosensitive drum. The photosensitive drum is an image bearing member on which an electrostatic latent image is formed, and the developing sleeve is a developer bearing member which carries and conveys the developer. The image forming apparatus then generally performs a developing process in which the electrostatic latent image is visualized using the developer.

An image forming apparatus employing a two-component developing method uses a two-component developer in which non-magnetic toner and magnetic carrier are mixed at a predetermined ratio. When such an image forming apparatus performs the developing process, the photosensitive drum and the developing sleeve are disposed opposing each other with a predetermined gap (i.e., an S-D gap) between each other. A developing bias is then applied to the developing sleeve, so that the developing process performed using the toner in the developer. In such a case, if the S-D gap is too wide, electric field intensity between the photosensitive drum and the developing sleeve is reduced, so that it becomes more difficult to perform the developing process. On the other hand, if the S-D gap is too narrow, the electric field intensity becomes excessively great, so that an abnormal electrical discharge becomes easily generated, and image defect such as ring-shaped dots may occur.

To solve such a problem, Japanese Patent Application Laid-Open No. 07-175321 discusses an image forming apparatus that retains the S-D gap within a predetermined range as follows. A gap retaining member is disposed at an edge portion of the developing sleeve to abut on the drum surface.

However, a problem arises in the image forming apparatus including an image forming unit that attaches the gap retaining member to the developing sleeve to abut on the photosensitive drum as discussed in Japanese Patent Application Laid-Open No. 07-175321. More specifically, there is friction against the gap retaining member due to rotation of the photosensitive drum or the developing sleeve. As a result, the gap retaining member becomes abraded, so that the S-D gap changes. In particular, abrasion is significant in the image forming apparatus in which a peripheral speed difference is set between the photosensitive drum and the developing sleeve that are disposed opposing to each other. The peripheral speed difference is set to convey a large amount of developer in a developing unit, i.e., the portion in which the photosensitive drum and the developing sleeve are disposed opposing each other, to improve developing performance. If the S-D gap becomes narrow due to abrasion of the gap retaining member, it becomes difficult for the two-component developer carried on and conveyed by the developing sleeve to pass through the S-D gap. Retention of the developer thus occurs in an area around the S-D gap.

The developer includes the magnetic carrier of which a thin layer is coated on the developing sleeve and is carried by a magnet disposed in the developing sleeve. If retention of the developer occurs in the area around the S-D gap as described above, the developer moves to a position in which the magnetic force of the magnet cannot hold the developer including the magnetic carrier. The developer including the magnetic carrier then overflows from a developing device, and eventually a transfer material to which the magnetic carrier attaches becomes discharged from the image forming apparatus. Further, the magnetic carrier that has overflowed from the developing device is conveyed to a transfer unit or a fixing unit along with the toner image, so that the image forming apparatus main body becomes greatly damaged.

SUMMARY OF THE INVENTION

The one of the aspects of present invention is directed to an image forming apparatus capable of reducing failure caused by retention of the developer occurring in the vicinity of the portion in which the developing sleeve and the photosensitive drum are disposed opposing each other. Such retention of the developer is caused by abrasion of the gap retaining member which retains the gap between the developer bearing member and the image bearing member by abutting on the image bearing member.

According to another aspect of the present invention, an image forming apparatus includes an image bearing member, a developing device including a developer bearing member disposed opposing the image bearing member in a developing region which carries and conveys developer including non-magnetic toner and magnetic carrier, configured to develop an electrostatic latent image formed on the image bearing member, a gap retaining member which is integrally replaced along with the developing device, configured to retain a distance between the image bearing member and the developer bearing member by abutting on both the image bearing member and the developer bearing member, and a control unit configured to control a potential difference between a potential of a non-image portion of the image bearing member and a developing bias applied to the developer bearing member, wherein in a case that based on a first information about a drive amount of the image bearing member and second information about a drive amount of the developer bearing member, an integrated value of the first information and the second information from initial installation or replacement of the developing device is greater than a predetermined value, the control unit decreases the potential difference according to an increase in the drive amounts of the image bearing member and the developer bearing member.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
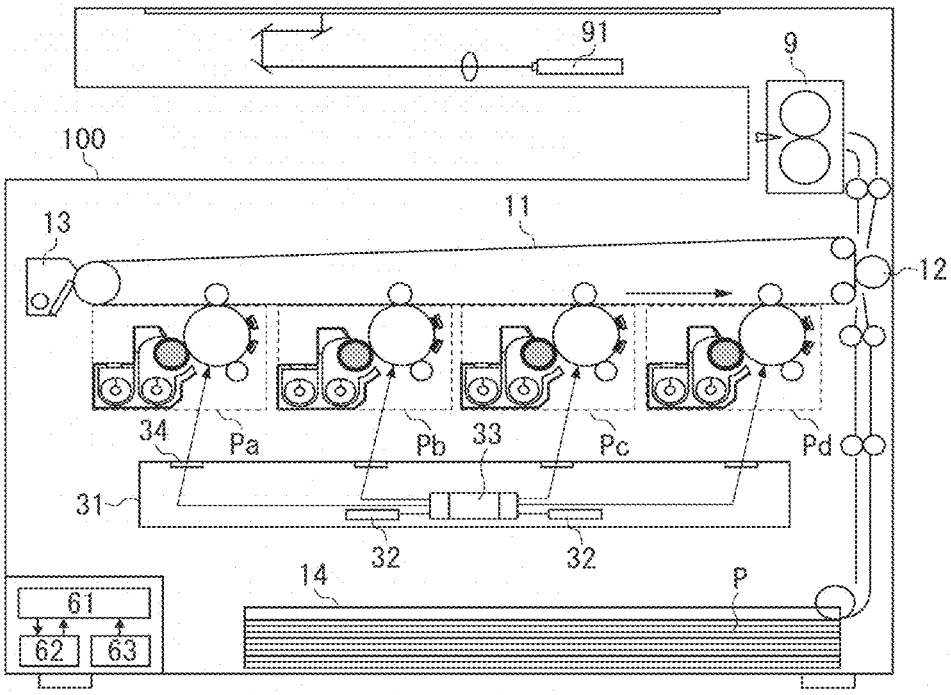
FIG. 1 is a schematic diagram illustrating a configuration of an example of an image forming apparatus according to the present invention.
Figure 2:
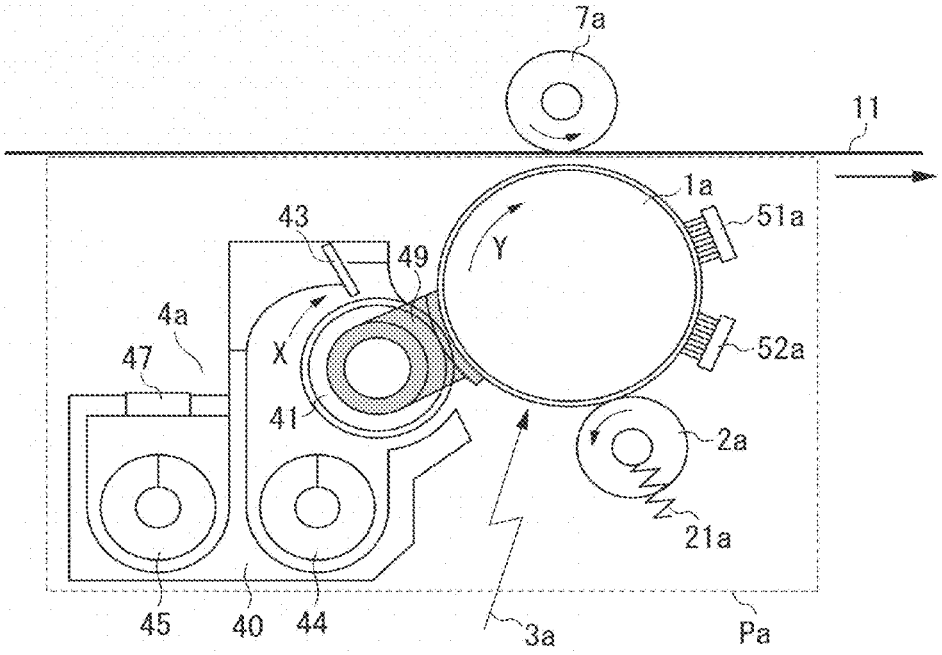
FIG. 2 is a schematic diagram illustrating an image forming station in the image forming apparatus illustrated in FIG. 1.

The first exemplary embodiment according to the present invention will be described below. FIGS. 1 and 2 are cross-sectional views illustrating an example of a color image forming apparatus employing an intermediate transfer method according to the present invention. According to the present exemplary embodiment, the image forming apparatus is a cleaner-less electrophotographic laser beam printer employing a contact charging method and a two-component contact developing method.

Referring to FIG. 1, an image forming apparatus 100 according to the present exemplary embodiment includes four image forming stations Pa, Pb, Pc, and Pd that are serially arranged in an image advancing direction. The four image forming stations Pa, Pb, Pc, and Pd are process cartridges that are detachably-attached to the image forming apparatus 100.

FIG. 2 is a cross-sectional view illustrating the image forming station Pa. The four image forming stations Pa, Pb, Pc, and Pd are similarly configured. Referring to FIG. 2, the image forming station Pa includes a photosensitive drum 1*a*, i.e., an image bearing member, a charging device 2*a*, an exposure device 3*a*, a developing device 4*a*, an upstream auxiliary charging device 51*a*, and a downstream auxiliary charging device 52*a*. Further, an intermediate transfer belt 11, i.e., an intermediate transfer member, is disposed to be movable in a direction indicated by an arrow illustrated in FIG. 2. The intermediate transfer belt 11 thus pass through photosensitive drums 1*a*, 1*b*, 1*c*, and 1*d* and primary transfer devices 7*a*, 7*b*, 7*c*, and 7*d* in each of the image forming stations Pa, Pb, Pc, and Pd.

Returning to FIG. 1, a scanner unit 31 containing a light source 32, a polygon mirror 33, and an exposure window 34 is disposed in a lower portion of the image forming apparatus 100. The polygon mirror 33 rotates and scans a laser beam emitted from the light source 32, and a plurality of reflective mirrors deflects a light flux of the scanned light. An fθ lens condenses the deflected light and exposes a generatrix of each of the photosensitive drums 1*a*, 1*b*, 1*c*, and 1*d* with the condensed light. An electrostatic latent image according to an image signal is thus formed on the photosensitive drums.

The developing devices 4*a*, 4*b*, 4*c*, and 4*d* in the four image forming stations Pa, Pb, Pc, and Pd are each filled with predetermined amount of the two-component developer. More specifically, in each of the two-component developers, yellow, magenta, cyan, or black non-magnetic toner is mixed with the magnetic carrier at a predetermined mixing ratio respectively. The developing devices 4*a*, 4*b*, 4*c*, and 4*d* thus sequentially develop the latent image on the photosensitive drums using the toner of each color and form a toner image. The toner image is then primary-transferred to the intermediate transfer belt 11. Further, a transfer material P contained in a transfer material cassette 14 is conveyed to a secondary transfer device 12, and the toner image carried on the intermediate transfer belt 11 is secondary-transferred to the transfer material P. A fixing unit 9 performs heating and pressing to fix the toner image on the transfer material P, and the transfer material P on which the toner image is fixed is then discharged as a recorded image to outside the image forming apparatus 100.

An intermediate transfer belt cleaning blade 13 cleans fog removal toner or secondary transfer residual toner attaching to the surface of the intermediate transfer belt 11. The intermediate transfer belt cleaning blade 13 constantly abuts on the intermediate transfer belt 11 downstream of the secondary transfer portion with respect to a movement direction of the intermediate transfer belt 11. On the other hand, primary transfer residual toner remaining on the photosensitive drum 1*a* in the image forming station Pa is collected in the developing device 4*a* after the upstream auxiliary charging device 51*a*, the downstream auxiliary charging device 52*a* and the charging device 2*a* performs charge amount control. Similar processes are also performed in the other image forming stations.

Further, the image forming apparatus 100 includes a central processing unit (CPU) 61 that controls the image forming apparatus. The CPU 61 is connected to a random access memory (RAM) 62 used as a working memory, and a read-only memory (ROM) 63 that stores programs to be executed by the CPU 61 and various data.

Figure 3:
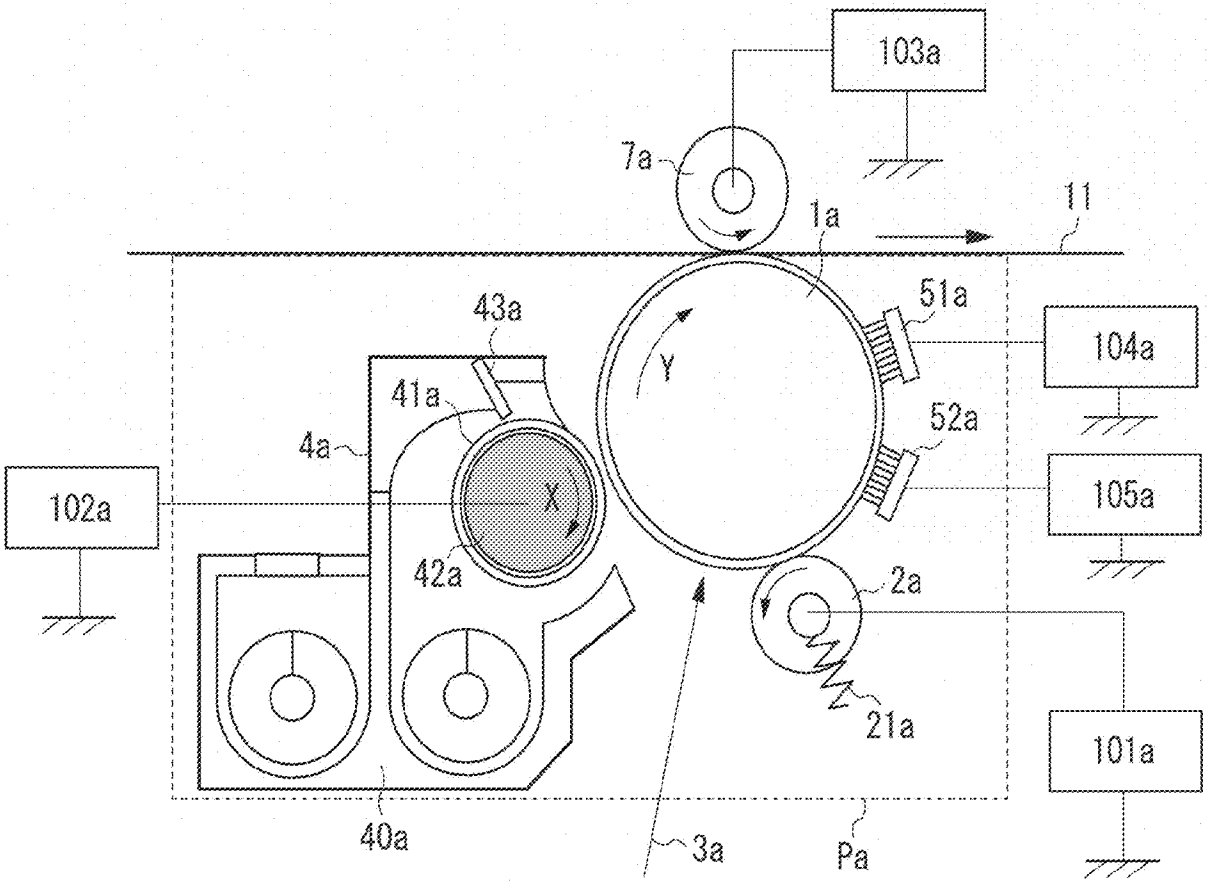
FIG. 3 is a schematic diagram illustrating a first image forming station Pa in the image forming apparatus illustrated in FIG. 1.

A charging process will be described below. An image forming process performed in the photosensitive drum and the surrounding components according to the present exemplary embodiment will be described below with reference to FIGS. 2 and 3. FIG. 3 is a schematic diagram illustrating the first image forming station Pa in the image forming apparatus. According to the present exemplary embodiment, the image forming apparatus forms an image at a process speed of 130 mm/sec.

The image forming apparatus 100 applies a high voltage on the contact charging device 2*a* to uniformly charge the surface of the photosensitive drum 1*a*. According to the present exemplary embodiment, the contact charging device 2*a* is a charging roller. However, the contact charging member may also be of other shape and material such as a fur brush and felt. Further, various materials may be combined to form a contact charging member having more appropriate elasticity, electrical conductivity, surface property, and durability.

Each end of a core of the charging roller 2*a* is held to be freely rotatable by a bearing member (not illustrated). Further, a pressing spring 21*a* biases the charging roller 2*a* towards the photosensitive drum 1*a*, so that the charging roller 2*a* is in press-contact with the surface of the photosensitive drum 1*a* at a predetermined pressing force. As a result, the charging roller 2*a* is rotatably driven along with the rotation of the photosensitive drum 1*a*. A high-voltage power source 101*a* applies a charging bias voltage of a predetermined condition on the core of the charging roller 2*a*. The surface of the rotating photosensitive drum 1*a* is thus contact-charged to a predetermined polarity and potential.

According to the present exemplary embodiment, the charging bias voltage applied to the charging roller 2*a* is a vibration voltage in which a direct current (DC) voltage and an alternating current (AC) voltage are superimposed one upon the other. More specifically, the charging bias voltage is a vibration voltage in which the DC voltage of −700 V and a sinusoidal AC voltage of a frequency 1.3 kHz and a peak-to-peak voltage Vpp=1.5 kV are superimposed one upon the other. The charging bias voltage thus uniformly charges the surface of the photosensitive drum 1*a* to −700V (i.e., dark potential Vd) which is substantially the same as the DC voltage applied to the charging roller 2*a*.

The image forming apparatus 100 then forms the electrostatic latent image on the charged photosensitive drum 1*a* using the exposure device 3*a*. According to the present exemplary embodiment, the exposure device 3*a* is a laser beam scanner using a semiconductor laser.

The developing process will be described below. The developing device 4*a* in the image forming apparatus 100 supplies the toner according to the electrostatic latent image formed on the photosensitive drum 1*a*, so that the toner image (i.e., developer image) is formed. According to the present exemplary embodiment, the developing device uses the two-component contact developing method. In such a method, the electrostatic latent image is developed by causing a magnetic brush formed of the two-component developer including the non-magnetic toner and the magnetic carrier to be in contact with the photosensitive drum.

The developing device 4*a* includes a non-magnetic developing sleeve 41*a*, i.e., the developer bearing member, in which a magnet 42*a* is fixedly-disposed in an internal portion thereof. A portion of an outer peripheral surface of the developing sleeve 41*a* is exposed to outside the developing device 4*a*. The developing sleeve 41*a* is disposed near and at a position opposing the photosensitive drum 1*a*, retaining a nearest distance (i.e., S-D gap) with the photosensitive drum 1*a* at 300 μm.

The region in which the photosensitive drum 1*a* and the developing sleeve 41*a* are positioned opposing each other is a developing region. A gap retaining member 49 which retains the S-D gap attaches to both ends in an axial direction of the developing sleeve 41*a*, to abut on the photosensitive drum 41*a*. Further, the developing sleeve 41*a* is rotatably driven in the developing portion in a rotational direction X which is in an opposite direction to a rotational direction Y of the photosensitive drum 1*a*. As a result, transfer residual toner or the fog removal toner re-charged by the auxiliary charging device or the charging device to be described below is efficiently collected in the developing device in the cleaner-less image forming apparatus.

According to the present exemplary embodiment, the magnetic carrier in the two-component developer has volume resistivity of approximately 1013 Ω·cm, and a particle diameter of approximately 40 μm (i.e., a volume mean particle diameter, measured using a laser diffraction-type particle size measuring apparatus HEROS (produced by Nippon Denshi Co., Ltd) by logarithmically dividing a range of 0.5 to 350 μm into 32 portions, and in which a median diameter providing 50% of volume is determined as a volume-average particle size). Further, the non-magnetic toner is formed of resin which mainly includes polyester, and a colorant or a charge control agent dispersed therein to provide a powder material having a volume mean particle diameter of approximately 7 μm. The nonmagnetic toner is frictionally charged to negative polarity by rubbing against the magnetic carrier.

The high-voltage power source 102*a* applies a predetermined developing bias on the developing sleeve 41*a*. According to the present exemplary embodiment, the developing bias voltage is a vibration voltage in which a DC voltage and an AC voltage are superimposed one upon the other. More specifically, the developing bias voltage is a vibration voltage in which a DC voltage of −500 V and an AC voltage of a rectangular wave of a frequency 8.0 kHz and a peak-to-peak voltage Vpp=1.8 kV are superimposed one upon the other. The electrostatic latent image is thus reversal-developed based on the above-described developing bias and the electric field of the electrostatic latent image formed on the surface of the photosensitive drum 1*a*.

In the above-described process, a charge amount of the toner developed on the photosensitive drum 1*a* is approximately −25 μC/g under an environment of a temperature 23° C. and an absolute moisture amount 10 g/m$^3$.

The transfer process will be described below. The primary transfer device 7*a* in the image forming apparatus 100 primary-transfers the developer image formed on the photosensitive drum 1*a* to the intermediate transfer belt 11. According to the present exemplary embodiment, the primary transfer device 7*a* is a transfer roller 7*a* which is caused to be in press-contact with the photosensitive drum 1*a* at a predetermined pressing force. A high-voltage power source 103*a* applies to the transfer roller 7*a* a transfer bias of a positive polarity which is of an opposite polarity to the charging polarity of the toner, i.e., negative polarity. According to the present exemplary embodiment, a transfer bias of +2 kV is applied to the transfer roller 7*a*. The toner is thus primary-transferred to the intermediate transfer belt 11.

An auxiliary charging process will be described below. There may be transfer residual toner or the fog toner which has not been primary transferred from the developer image developed on the photosensitive drum 1*a*. Such residual toner or fog toner is conveyed to the upstream auxiliary charging device 51*a* and the downstream auxiliary charging device 52*a*, and the charge polarity of the toner is then adjusted to a regular charging state. According to the present exemplary embodiment, both the upstream auxiliary charging device 51*a* and the downstream auxiliary charging device 52*a* are charging brushes. However, the auxiliary charging device is not limited to a fixed brush member, and may be members of any suitable shape, such as a brush-shaped rotary member, an elastic roller, or a sheet-shaped member.

The upstream auxiliary charging device 51*a* is connected to a high-voltage power source 104*a*, and the downstream auxiliary charging device 52*a* is connected to a high-voltage power source 105*a*. The high-voltage power source 104*a* applies to the upstream auxiliary charging device 51*a* a DC voltage of a polarity which is of an opposite polarity to the regular charging polarity of the toner, i.e., negative polarity. According to the present exemplary embodiment, a voltage of +300 V is applied to the upstream auxiliary charging device 51*a*. Further, the high-voltage power source 105*a* applies to the downstream auxiliary charging device 52*a* a DC voltage of the same polarity as the regular charging polarity of the toner, i.e., negative polarity. According to the present exemplary embodiment, a voltage of −800 V is applied to the downstream auxiliary charging device 52*a*. The upstream auxiliary charging device 51*a* and the downstream auxiliary charging device 52*a* thus adjust the charging polarity of the residual toner after transfer to the negative polarity, which is the regular charging state.

A vibration electrical field in which the DC voltage and the AC voltage are superimposed one upon the other then adjust the charge amount of the residual toner after transfer which has been adjusted to the regular charging polarity. A charge amount distribution of the toner thus becomes a narrow area distribution.

The developing device 4*a* then collects the transfer residual toner and the fog toner whose charge amounts have been adjusted, by applying a fog removal potential (Vback) of +200 V. The developing device 4*a* collects the toner at the same time as performing the developing process. The fog removal potential (Vback) is a potential difference between a dark potential (Vd) of the photosensitive drum, i.e., a potential of a non-imaging portion, and a DC voltage (Vdc) applied to the developing sleeve 41.

The four cleaner-less image forming stations as described above are disposed in parallel, and a color image is thus formed by the four image forming portions Pa, Pb, Pc and Pd.

Figure 4:
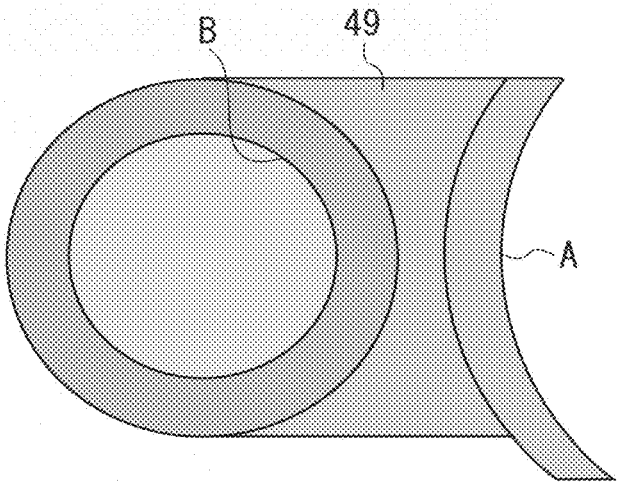
FIG. 4 is a schematic diagram illustrating a gap retaining member 49 according to a first exemplary embodiment.

The gap retaining member will be described below. FIG. 4 is a schematic diagram illustrating a gap retaining member 49 which retains the S-D gap according to the present exemplary embodiment. Referring to FIG. 4, the gap retaining member 49 has a curved surface A and a circumferential surface B. The curved surface A is in contact with the photosensitive drum 1*a*, and end shaft of the developing sleeve 41 pass through and are in contact with the circumferential surface B. Curvatures of the curved surface A and the circumferential surface B are each approximately equal to the photosensitive drum 1*a* and the developing sleeve 41 in contact therewith. According to the present exemplary embodiment, the gap retaining member 49 is formed of polyamide (PA). The gap retaining member 49 may also be formed of resins such as polyphthalamide (PPA), polyphenylene sulfide (PPS), polyamide-imide (PAI), and polyacetal (POM). The gap retaining member 49 is pressed from the developing sleeve side to the photosensitive drum side to abut on the photosensitive drum, and thus retains the S-D gap.

Since a contact area between the gap retaining member shaped as illustrated in FIG. 4 and the photosensitive drum is large, the pressing force becomes dispersed, and abrasion of the gap retaining member is reduced. Further, a periodic change in the S-D gap between the developing sleeve and the photosensitive drum hardly occurs even when toner agglomerate or the carrier is sandwiched between the photosensitive drum and the gap retaining member.

However, if a large number of image forming processes is repeatedly performed, the curved surface A comes into contact with and causes friction with the photosensitive drum 1, and the circumferential surface B comes into contact with and causes friction with the end portions of the shaft of the developing sleeve 41. The curvature A and the circumferential surface B of the gap retaining member 49 thus become abraded, and the S-D gap becomes narrow. If the S-D gap becomes too narrow, it becomes difficult for the developer carried on and conveyed by the developer sleeve 41 to pass through the S-D gap, so that retention of the developer occurs in the area around the S-D gap.

Figure 5:
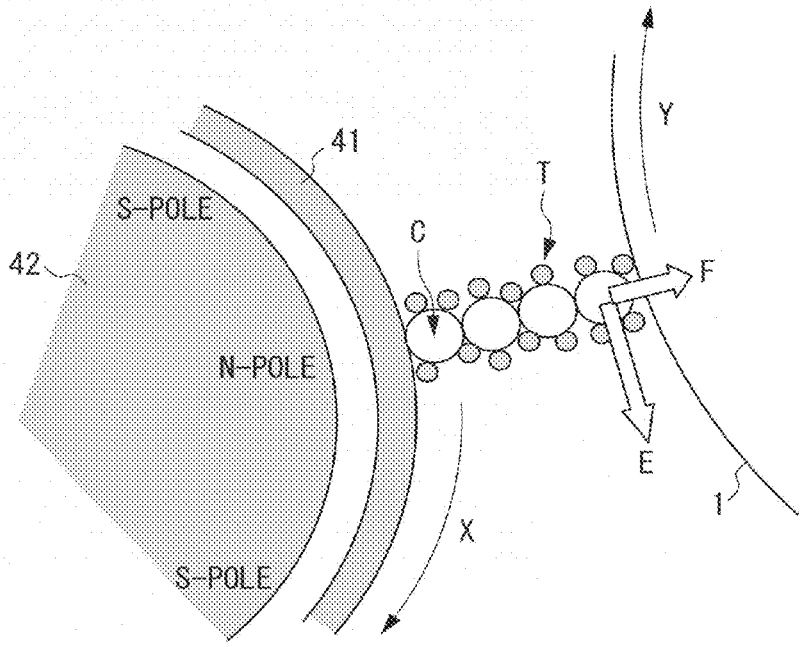
FIG. 5 is a schematic diagram illustrating an area surrounding a developing unit in the image forming apparatus according to the first exemplary embodiment.

A mechanism of retention caused by a change in the S-D gap will be described below. The retention of the developer will be described below with reference to FIGS. 5, 6A, 6B, and 7. FIG. 5 is a schematic diagram illustrating an area surrounding the developing unit in the image forming apparatus according to the present exemplary embodiment. Referring to FIG. 5, a two-component developer including non-magnetic toner T and magnetic toner C is pulled towards the developing sleeve 41 by a magnetic force of the magnet 42 fixedly-disposed within the developing sleeve 41. The non-magnetic developing sleeve 41 whose surface roughness Rz is processed to be 10 μm by performing blast processing, is rotated in a direction indicated by an arrow X illustrated in FIG. 5. The two-component developer is thus carried and conveyed in the direction indicated by the arrow X while ears are standing.

Further, the photosensitive drum 1 is rotated in a direction indicated by an arrow Y illustrated in FIG. 5, i.e., in an opposite direction to the rotation of the developing sleeve 41, at the position in which the photosensitive drum 1 is positioned opposing the developing sleeve 41. If the S-D gap becomes narrow, the developer whose ears are standing comes into contact with the photosensitive drum 1, so that a tangential conveying force caused by rotation of the developing sleeve 41 becomes cut off. As a result, it becomes difficult for the developer to pass through the S-D gap, and an amount of the developer passing through the S-D gap becomes less than the amount of the developer carried and conveyed to the S-D gap. Retention of the developer thus occurs.

If the amount of the retained developer increases so that retention of the developer occurs at a position far from the developing sleeve 41, the magnetic force of the magnet 42, i.e., a force for holding the developer toward the developing sleeve 41, becomes weak. As a result, the developer sleeve 41 cannot hold the developer, and the developer is thus conveyed along the rotational direction Y of the photosensitive drum 1.

Figure 6A:
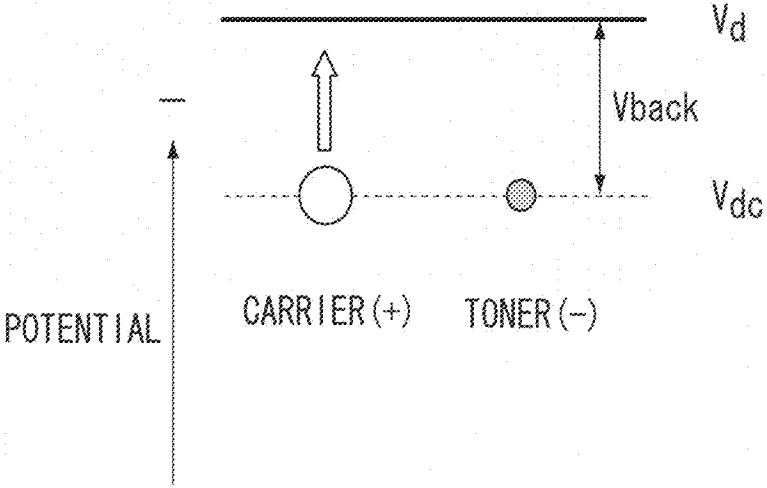
FIGS. 6A and 6B illustrate potentials in the developing unit in the image forming apparatus according to the first exemplary embodiment.
Figure 6B:
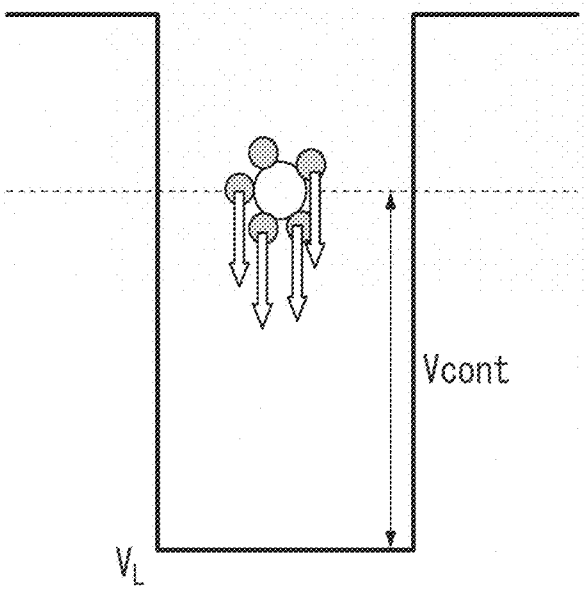

FIGS. 6A and 6B illustrate the electric field formed in a blank portion (FIG. 6A), and the electric field formed in a solid portion (FIG. 6B). According to the present invention, the image forming apparatus employs a reversal-developing method and develops the toner on the portion where the exposure device has formed the electrostatic latent image. Further, the developer agitates the non-magnetic toner and the magnetic carrier inside the developing device 4 to apply an electric charge by friction-charging. The non-magnetic toner is thus charged to a negative polarity (−), and the magnetic carrier is charged to a positive polarity (+).

Referring to FIG. 6A, the photosensitive drum potential (Vd) and the developing sleeve potential (Vdc) in the blank portion are in a fog removal potential (Vback) state. According to the present exemplary embodiment, the photosensitive drum potential Vd is set to −700 V, and the developing sleeve potential Vdc to −500 V. The toner of a negative polarity then remains in the developing sleeve potential (Vdc). However, the carrier of a positive polarity is caused to move towards the photosensitive drum potential (Vd) which is of a further negative potential. A force F, which is different from a tangential force E caused by the rotation of the developing sleeve 41, then becomes applied from the developing sleeve 41 to the photosensitive drum 1, so that the conveying speed of the developer is reduced. The retention of the developer thus becomes likely to occur in the S-D gap.

Further, referring to FIG. 6B, the exposure device causes the photosensitive drum potential in the solid image portion to become a latent image potential (VL). In such a case, the potential difference between the developing sleeve potential (Vdc) and the latent image potential (VL) becomes a contrast potential (Vcont).

According to the present exemplary embodiment, the latent image potential VL in the solid image is set to approximately −140 V to −300 V, even when the latent image potential VL changes by performing image density control. A force thus becomes applied to the toner of a negative polarity so that the toner moves toward the latent image potential (VL) whose potential is more positive. The carrier of the positive polarity remains in the developing sleeve potential (Vdc).

However, in the case of the solid image, the amount of toner developed on the photosensitive drum is large, so that the carrier is also developed on the photosensitive drum along with the toner which is electrostatic-adhering to a surface of the carrier. Phenomenon of adhesion of the carrier in the solid image thus occurs. The force F, which is different from the tangential force E caused by the rotation of the developing sleeve 41, then becomes applied from the developing sleeve 41 to the photosensitive drum 1. As a result, the conveying speed of the developer is reduced and retention of the developer becomes likely to occur in the S-D gap.

Figure 7:
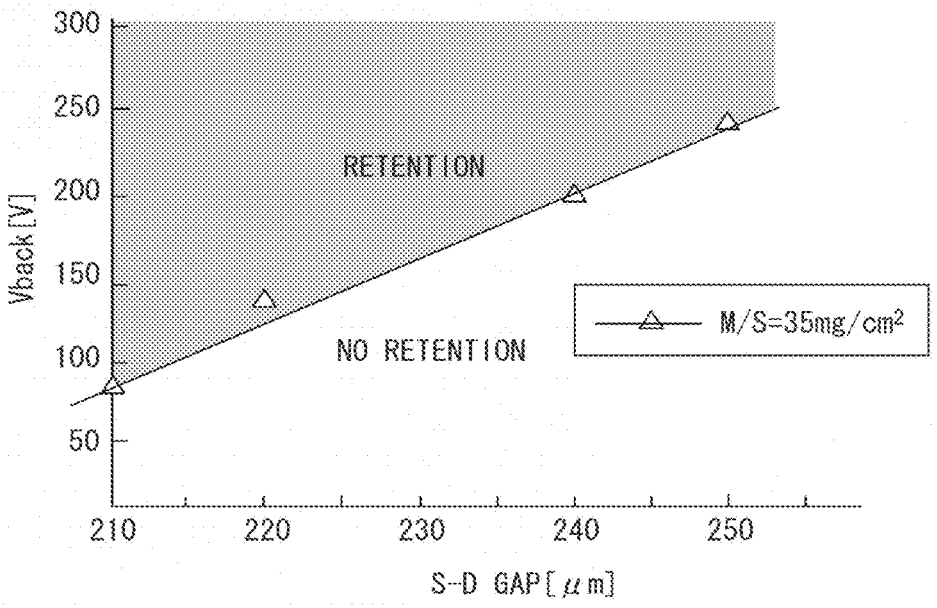
FIG. 7 is a graph illustrating a relationship between a fog-removal potential, an S-D gap, and retention of the developer in the image forming apparatus according to the first exemplary embodiment.

FIG. 7 is a graph illustrating a relationship among the fog removal potential (Vback), the S-D gap, and retention of the developer according to the present exemplary embodiment. The graph illustrated in FIG. 7 indicates a condition in which retention occurs in the image forming apparatus according to the present exemplary embodiment. A developer amount coated on a developing position of the developing sleeve per an area of 1 $cm^2$ (M/S) is 35 $mg/cm^2$. Referring to FIG. 7, if the gap retaining member 49 is abraded and the S-D gap is narrowed to 240 μm, and Vback is set greater than or equal to 200 V, retention of the developer occurs in the blank portion. If abrasion is further generated, and the S-D gap is narrowed to 210 μm, retention of the developer occurs in the blank portion when Vback is set greater than or equal to 80 V. Retention of the developer occurs due to the following reason. The force applied in the direction F from the developing sleeve 41 to the photosensitive drum 1 increases as Vback increases, so that the conveying speed of the developer by the developing sleeve 41 decreases. In other words, it becomes likely for retention of the developer to occur as the S-D gap becomes narrower, and as Vback increases. Similarly, it becomes more likely for retention of the developer to occur as the contrast potential Vcont increases.

Control performed according to the present exemplary embodiment will be described below with reference to FIGS. 8, 9, 10, 11, and 12.

Figure 8:
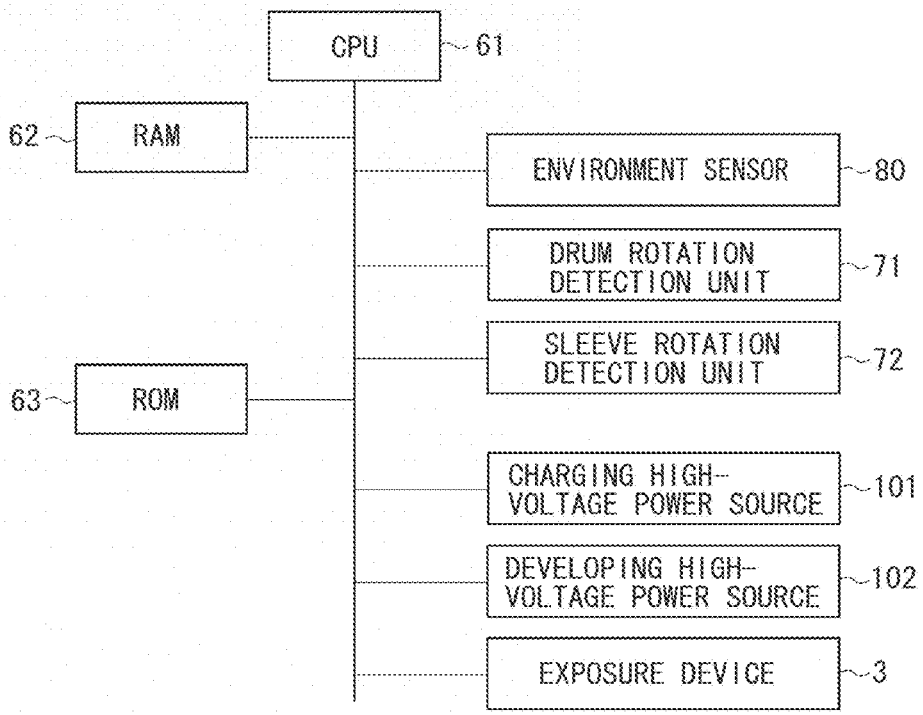
FIG. 8 is a block diagram illustrating a detection unit and a control unit which perform control according to the first exemplary embodiment.

Control of the Vback (i.e., a first control) will be described below. FIG. 8 is a block diagram illustrating a detection unit and a control unit for performing control according to the present exemplary embodiment. Referring to FIG. 8, the control unit includes the CPU 61. The CPU 61 is connected to the RAM 62 to be used as the work memory, the ROM 63 which stores the programs to be executed by the CPU and various data, an environmental sensor 80 which detects an environment surrounding the image forming apparatus, and a photosensitive drum rotation detection unit 71. Further, the CPU 61 is connected to a developing sleeve rotation detection unit 72, a charging high-voltage power source 101 which applies a charging bias to the charging device 2 for charging the photosensitive drum 1, a developing high-voltage power source 102 which applies a developing bias to the developing sleeve 41, and the exposure device 3 which forms the electrostatic latent image.

Figure 9:
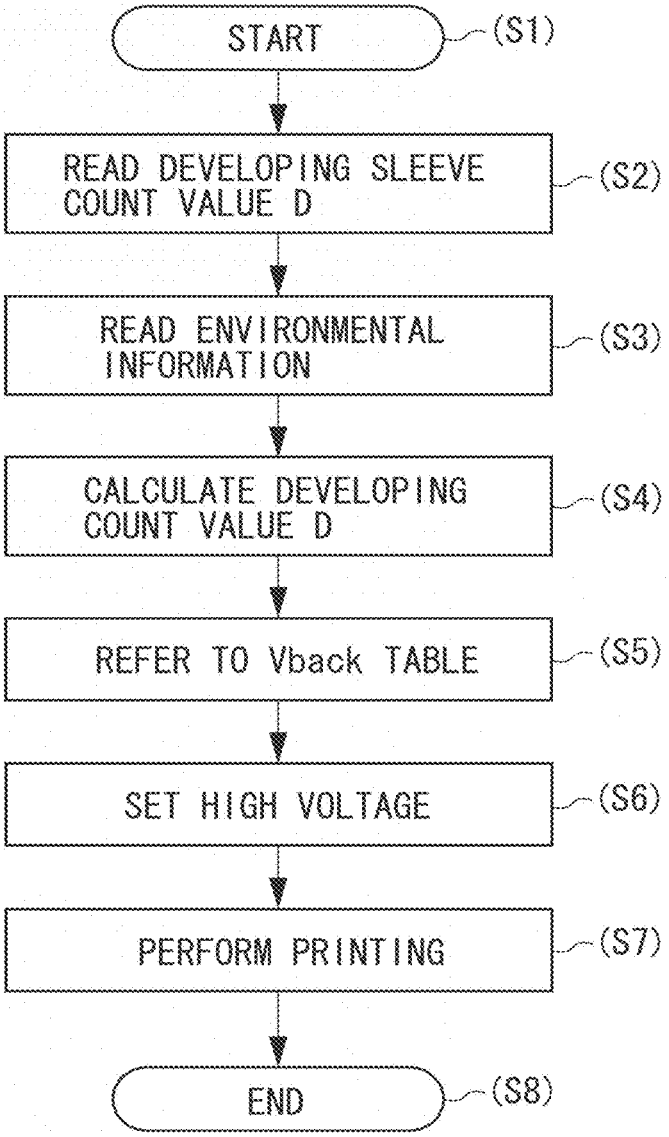
FIG. 9 is a flowchart illustrating a process for performing high-voltage control based on driving of the developing sleeve according to the first exemplary embodiment.

FIG. 9 is a flowchart illustrating a process for performing high-voltage control according to driving of the developing sleeve.

In step S1, the image forming apparatus starts to operate. In step S2, the CPU 61 reads from the back-up RAM 62 a developing count value D (i.e., an integrated value of the drive amount of the developing sleeve) which has been reached before the current image forming process. In step S3, the environmental sensor 80 detects the temperature and the humidity surrounding the image forming apparatus.

In step S4, the developing sleeve rotation detection unit 72 calculates the developing count value D based on a total drive time of the developing sleeve detected from initial installation or replacement of the developing device. The developing count value D is calculated by dividing a drive time TS of the developing sleeve by a drive time TS0 of the developing sleeve for forming an image on one sheet. The drive time TS is thus converted to a corresponding number of sheets of images that have been formed. In other words, the developing count value D corresponds to a total number of rotations of the developing sleeve. According to the present exemplary embodiment, the developing device or the process cartridge including the developing device is integrally replaced. The deterioration of the developer can thus be detected by acquiring the number of rotations of the developing sleeve starting from the initial installation or replacement of the developing device.

The developing sleeve drive time TS is counted up when the developing sleeve is driven in performing various control in processes other than the image forming process (e.g., image density control, color misregistration correction control, and toner density control). Further, the developing sleeve drive time TS is counted up when the developing sleeve is driven in a preliminary multi-rotation in the case where the image forming apparatus is switched on or restored from a sleep mode.

Figure 10:
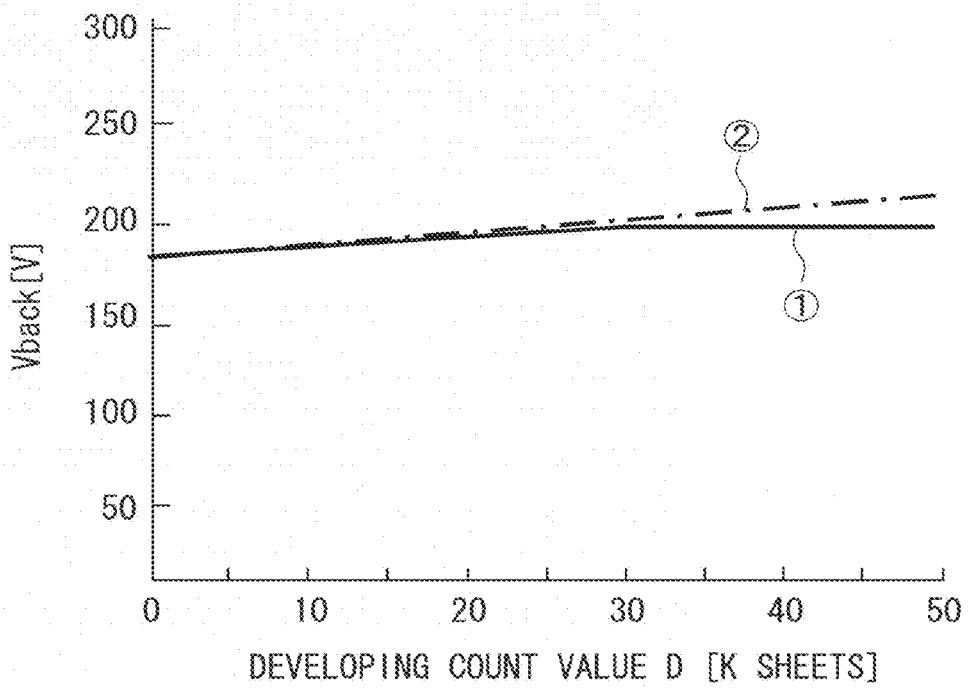
FIG. 10 illustrates a Vback table for performing control according to a developing count value.

In step S5, the CPU 61 determines a setting of the fog removal potential (Vback) as illustrated in FIG. 10, based on the calculated developing count value D and environmental data. In step S6, the CPU 61 determines and applies the voltage of the charging high-voltage power source 101 and the developing high-voltage power source 102 based on an environmental table including the charging bias and the developing bias. In step S7, the image forming process is performed.

FIG. 10 illustrates a Vback table for controlling Vback according to the developing count value D. Referring to FIG. 10, a solid line 1 indicates a usage table of the fog removal potential in a low humidity environment (i.e., an absolute moisture is 1.0 g). A broken line 2 indicates usage table of the fog removal potential in a high humidity environment (i.e., an absolute moisture is 22.0 g). Referring to the solid line 1 and the broken line 2, control is performed to increase the fog removal potential Vback as the developing count value D increases. Further, in the high humidity environment, the fog removal potential Vback is further increased as the developing sleeve is further used, as compared to the low humidity environment, for a reason to be described below.

When the developing sleeve 41 is driven, the two-component developer in the developing device 4 is agitated, and a regulating member 43 illustrated in FIG. 2 regulates and coats a thin layer of the developer on the developing sleeve 41. In such a case, friction between the developer occurs, or the developer is pressed at a developer pool in an upstream portion of the regulating member 43 with respect to the rotational direction of the developing sleeve 41. As a result, silica or titan attaching to the surface of the toner in the developer becomes embedding or disengaged, or the toner becomes fused to the surface of the magnetic carrier, so that it becomes likely for the toner charge amount to be lowered.

The toner of a low charge amount is less likely to be affected by the electric field in the developing unit. An image failure, such as fogging of the blank portion in which the toner attaches to the photosensitive drum, thus occurs even when the fog removal potential Vback is applied. To solve such a problem, the fog removal potential Vback is increased, so that fogging does not occur when the toner is of a low charge amount. Further, in the high humidity environment, surface resistivity and volume resistivity are lowered by moisture becoming attached to the carrier, the toner, or an external additive. It thus becomes difficult for the electric charge to be applied by friction, so that the toner charge amount becomes low. In such a case, the fog removal potential Vback is further increased.

In the above-described first control according to the present exemplary embodiment, the developing count value D (i.e., the integrated value of the drive amount of the developing sleeve) is calculated based on the drive time TS of the developing sleeve and drive time TS0 of the developing sleeve for forming one sheet of an image. However, the present invention is not limited to the above. For example, the drive time TS may be directly set as the developing count value D. In such a case, detection accuracy is slightly reduced. Further, an integrated value of the number of images formed on the sheets may be directly used as the developing count value D. Furthermore, the drive time of an agitation screw which agitates the developer in the developing device, or the drive time of the photosensitive drum may be employed instead of the drive time of the developing sleeve.

Vback control in response to abrasion of the gap retaining member 49 (i.e., a second control), will be described below with reference to FIGS. 11 and 12.

Figure 11:
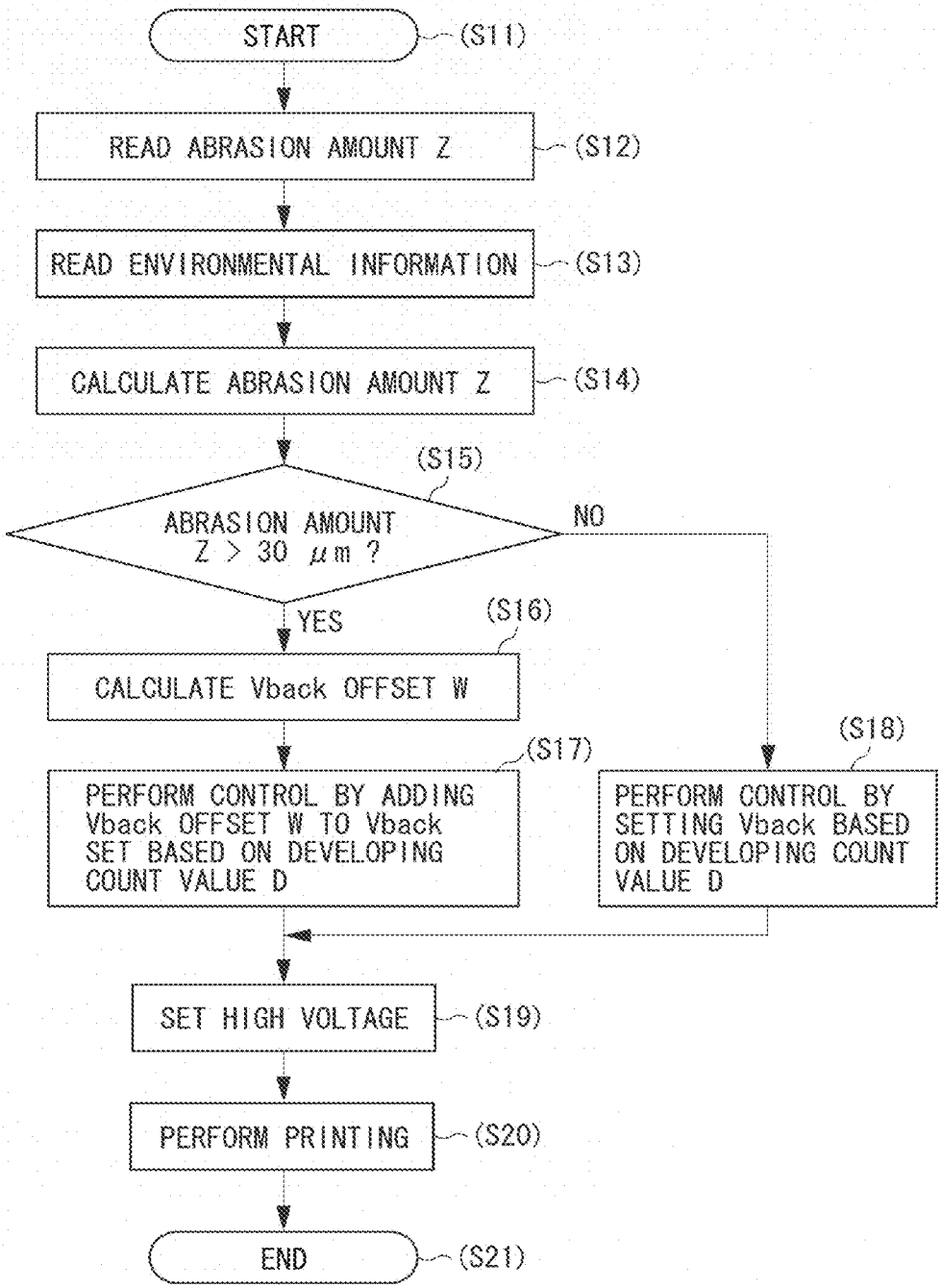
FIG. 11 is a flowchart illustrating a process for performing high-voltage control based on an abrasion amount of the gap retaining member according to the first exemplary embodiment.
Figure 12:
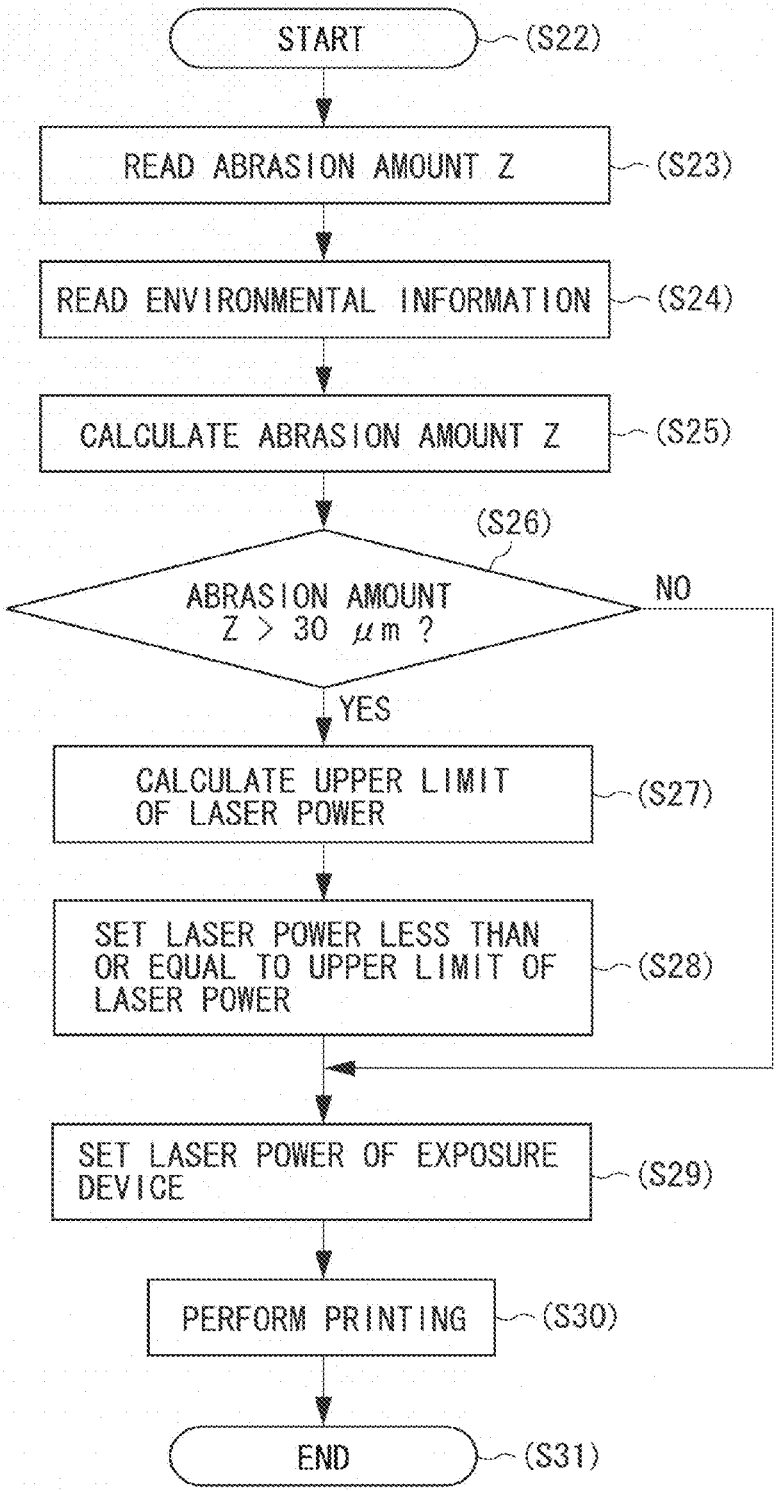
FIG. 12 is a flowchart illustrating a process for controlling a contrast potential based on the abrasion amount of the gap retaining member according to the first exemplary embodiment.

FIG. 11 is a flowchart illustrating a process for performing high-voltage control according to an abrasion amount of the gap retaining member.

According to the present exemplary embodiment, an abrasion amount Z of the gap retaining member is acquired by detecting information about a drive amount of the developing sleeve from the initial installation or replacement of the developing device. According to the present invention, the developing device or the process cartridge including the developing device is integrally replaced along with the gap retaining member. The number of rotations of the developing sleeve from the initial installation or replacement thus corresponds to the abrasion amount of the gap retaining member.

In step S11, the image forming apparatus start to operate. In step S12, the CPU 61 reads from the back-up RAM 62 the abrasion amount Z of the gap retaining member generated before the current image forming process. In step S13, the environmental sensor 80 detects the temperature and the humidity surrounding the image forming apparatus. In step S14, the abrasion amount Z is calculated using a drive time TD of the photosensitive drum 1 detected by the photosensitive drum rotation detection unit 71 from the initial installation or the replacement of the developing device. The abrasion amount Z is calculated also using a drive time TS of the developing sleeve 41 detected by the developing sleeve detection unit 72. The abrasion amount Z is thus calculated as a sum of the abrasion amount due to driving of the photosensitive drum and the abrasion amount due to driving of the developing sleeve.

The abrasion amount due to driving of the photosensitive drum is calculated by assuming that the curved surface A of the gap retaining member 49 is abraded by 10 μm when the photosensitive drum 1 is driven to form 30000 sheets of images. The abrasion amount is calculated by dividing an increase in the drive time TD of the photosensitive drum 1 in the main body operation by the drive time TD0 of the photosensitive drum 1 for forming one sheet of an image, and multiplying by 10/30000 (μm/sheet). Further, the abrasion amount due to driving of the developing sleeve is calculated by assuming that the circumferential surface B of the gap retaining member 49 is abraded by 20 μm when the photosensitive drum 1 is driven to form 30000 sheets of images. The abrasion amount is calculated by dividing an increase in the drive time TS of the developing sleeve 41 in the main body operation by the drive time TS0 of the developing sleeve 41 for forming one sheet of an image, and multiplying by 20/30000 (μm/sheet). The abrasion amount of the gap retaining member is thus predicted.

The image forming apparatus according to the present exemplary embodiment does not include a mechanism for separating the primary transfer devices 7*a*, 7*b*, 7*c*, and 7*d* from the photosensitive drums 1*a*, 1*b*, 1*c*, and 1*d*. As a result, when the image forming apparatus performs a monochrome image forming process, the photosensitive drums 1*a*, 1*b*, 1*c*, and 1*d* are driven. Further, when the image forming apparatus performs the monochrome image forming process, the developing sleeve 41*d* containing the black developer among the developing sleeves 41*a*, 41*b*, 41*c*, and 41*d* is driven. However, the developing sleeves 41*a*, 41*b*, and 41*c* containing the yellow, magenta, and cyan developers respectively are not driven. If the image forming apparatus then performs a full-color image forming process, abrasion occurs in both the curved surface A which is in contact with the photosensitive drum 1, and the circumferential surface B which is in contact with the developing sleeve 41, of the gap retaining members 49 as illustrated in FIG. 4 in the image forming stations Pa, Pb, Pc, and Pd.

When the image forming apparatus performs the monochrome image forming process, abrasion occurs in both the curved surface A which is in contact with the photosensitive drum 1 and the circumferential surface B which is in contact with the developing sleeve 41 of the gap retaining member 49 in the black image forming station Pd. On the other hand, only the curved surface A of the gap retaining member 49 which is in contact with the photosensitive drum 1 becomes abraded in the image forming stations Pa, Pb, and Pc corresponding to yellow, magenta, and cyan. The abrasion amount Z thus differs depending on the image forming station and an imaging mode.

In step S15, the CPU 61 determines whether the calculated abrasion amount Z is greater than 30 μm. If the CPU 61 determines that the abrasion amount Z is greater than 30 μm (YES in step S15), the process proceeds to step S16. In step S16, the CPU 61 calculates a Vback offset W according to the abrasion amount. According to the present exemplary embodiment, a setting value of the S-D gap is 300±20 μm including tolerance, and a process unit of a lower limit of tolerance is used from a setting value of 280 μm. If the gap retaining member is abraded by 30 μm and the S-D gap becomes 250 μm as illustrated in FIG. 7, retention of the developer occurs when the fog removal potential Vback is set greater than or equal to 250 V. In such a case, control is performed to reduce Vback to prevent retention of the developer.

As described above, based on the integrated value of the drive time of the developing sleeve, there is a period in which the value of the Vback is reduced to suppress retention of the developer caused by the change in the S-D gap due to abrasion of the gap retaining member. The Vback offset W is calculated by adding an offset of −6 V for each 1 μm of abrasion when the abrasion amount exceeds 30 μm, for the following reason. Referring to FIG. 7, when the S-D gap becomes narrow by 10 μm, it becomes necessary to reduce Vback by 45 V. If Vback is reduced by more than 45 V, retention of the developer does not occur.

In step S17, the CPU 61 adds to the setting of the fog removal potential Vback illustrated in FIG. 9, the Vback offset W according to the abrasion amount, based on the developing count value D and the environmental data. In step S19, the CPU 61 then determines and applies the high voltage settings of the charging high-voltage power source 101 and the developing high-voltage power source 102 based on the environmental table including the charging bias and the developing bias. In step S20, the image forming process is performed.

If the CPU 61 determines that the calculated abrasion amount Z is less than or equal to 30 μm (NO in step S15), the process proceeds to step S18. In step S18, the CPU 61 sets the Vback based on the developing count value D as illustrated in FIG. 9. In step S19, the CPU 61 then determines and applies the high voltage setting. In step S20, the image forming process is performed.

According to the present exemplary embodiment, the change amount in Vback is greater in Vback control performed in response to abrasion of the gap retaining member (i.e., the second control) as compared to Vback control performed in response to deterioration of the developer (i.e., the first control). As a result, if the abrasion amount exceeds 30 μm, control is performed to reduce Vback along with an increase in the number of rotations of the developing sleeve.

Further, Vback control in response to abrasion of the gap retaining member (i.e., the second control) is performed at a later stage of usage. On the other hand, the first control is performed at an earlier stage as compared to the second control. There is thus a period in which the Vback is increased to prevent deterioration of the developer, and then a period in which Vback is decreased to correspond to retention of the developer due to abrasion of the gap retaining member. Such switching between the periods is performed along with the usage of the image forming apparatus.

Control of the contrast potential Vcont performed in response to abrasion of the gap retaining member will be described below. FIG. 12 is a flowchart illustrating a process for controlling the contrast potential Vcont according to the abrasion amount of the gap retaining member. According to the present exemplary embodiment, the contrast potential is controlled by controlling light amount of the laser, i.e., the exposure unit.

In step S22, the image forming apparatus starts to operate. In step S23, the CPU 61 reads from the back-up RAM 62 the abrasion amount Z of the gap retaining member before the current image forming process. In step S24, the environmental sensor 80 detects the temperature and the humidity of the area around the image forming apparatus. In step S25, the CPU 61 calculates the abrasion amount Z using the drive time TD of the photosensitive drum 1 detected by the photosensitive drum rotation detection unit 71 and the drive time TS of the developing sleeve 41 detected by the developing sleeve rotation detection unit 72.

In step S26, the CPU 61 determines whether the calculated abrasion amount Z is greater than 30 μm. If the CPU 61 determines that the calculated abrasion amount Z is greater than 30 μm (YES in step S26), the process proceeds to step S27. In step S27, the CPU 61 calculates an upper limit of the laser power of the exposure device 3 according to the abrasion amount. According to the present exemplary embodiment, if the latent image is formed on the photosensitive drum in the image forming apparatus so that the laser power becomes 0.32 $\mu J/cm^2$ drum surface light amount when the photosensitive drum is uniformly charged to Vd=−700 V, the latent image potential VL becomes −140 V.

Further, if the latent image is formed so that the laser power becomes 0.26 $\mu J/cm^2$ drum surface light amount, the latent image potential VL becomes −172 V. Furthermore, if the latent image is formed so that the laser power becomes 0.20 $\mu J/cm^2$ drum surface light amount, the latent image potential VL becomes −224 V. When Vback is set to 200 V, the developing bias potential Vdc=−500 V. Since the contrast potential Vcont=Vdc−VL, the contrast potential becomes lower when the laser power is small, and the retention of the developer is less likely to occur. According to the present exemplary embodiment, the calculation of the upper limit of the laser power is performed so that the upper limit becomes the laser power of the light amount in which the latent potential VL becomes lower by −5 V for 1 μm of abrasion when the abrasion amount exceeds 30 μm.

In step S28, if the laser power determined by performing image density control is greater than the upper limit of the laser power, the CPU 61 sets the laser power to the upper limit of the laser power. On the other hand, if the laser power determined by performing image density control is smaller than the upper limit of the laser power, the CPU 61 uses the laser power determined by performing image density control. In step S29, the CPU 61 sets the laser power of the exposure device 3. In step S30, the image forming process is performed.

If the CPU 61 determines that the calculated abrasion amount Z is less than or equal to 30 μm (NO in step S26), the process proceeds to step S29. In step S29, the CPU 61 sets the laser power of the exposure device 3 to the laser power determined by performing image density control. In step S30, the image forming process is performed.

By performing the above-described control, the abrasion amount of the gap retaining member between the photosensitive drum and the developing sleeve is predicted from the drive time of the photosensitive drum and the drive time of the developing sleeve. The fog removal potential and the contrast potential are then controlled according to the abrasion amount. As a result, retention of the developer does not occur even when the S-D gap becomes narrow due to abrasion of the gap retaining member caused by performing a large number of image forming processes.

According to the present exemplary embodiment, the nearest distance between the photosensitive drum and the developing sleeve (i.e., the S-D gap) is retained by the gap retaining members. The gap retaining members attach to both ends in the axial direction of the developing sleeve to abut on the photosensitive drum. The image forming stations in the image forming apparatus thus retain the S-D gap. The abrasion amount of the gap retaining member is then predicted from the drive time of the photosensitive drum and the drive time of the developing sleeve. The fog removal potential is thus decreased according to the abrasion amount. Further, control is performed so that the contrast potential does not become large. As a result, retention of the developer in the vicinity of the area where the developing sleeve and the photosensitive drum face each other is prevented. Further, the failure caused by the developer including the magnetic carrier overflowing from the developing device can be prevented.

Figure 13:
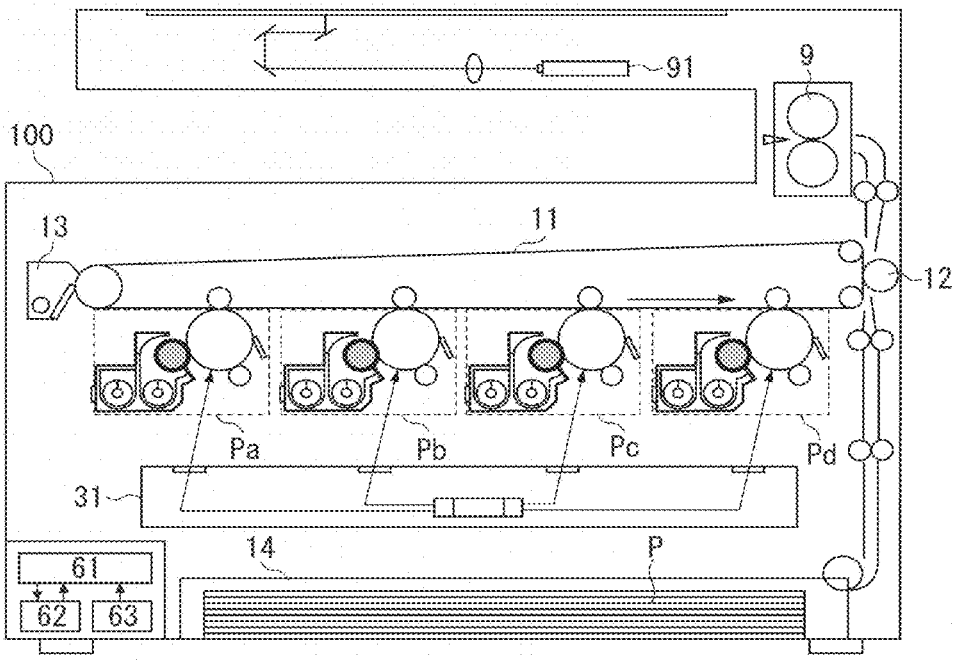
FIG. 13 is a schematic diagram illustrating another example of an image forming apparatus according to the present invention.

According to the present exemplary embodiment, the cleaner-less image forming apparatus includes the upstream auxiliary charging device 51 and the downstream auxiliary charging device 52. However, this is not a limitation, and the similar effect can be acquired by performing the above-described control in an image forming apparatus including a photosensitive drum cleaning device that cleans the transfer residual toner, instead of the auxiliary charging device. Such an apparatus is illustrated in FIG. 13.

Figure 14:
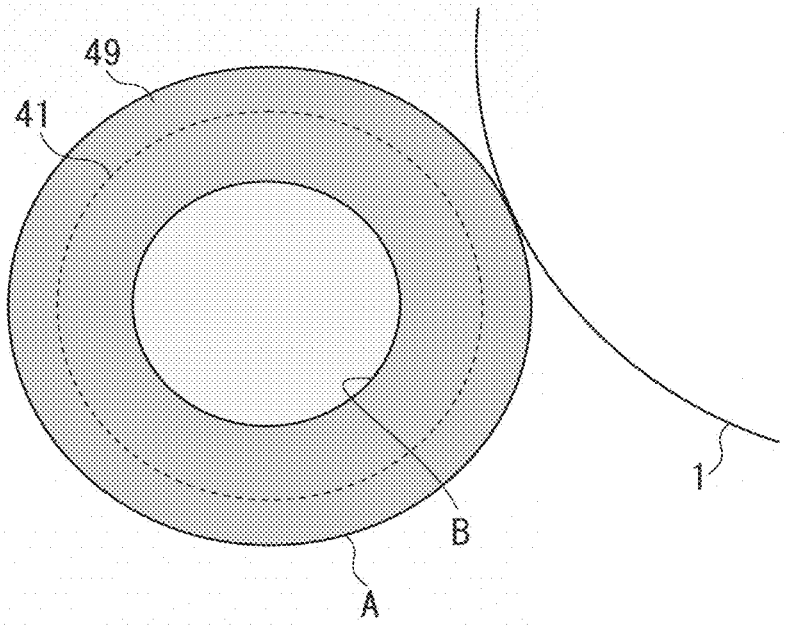
FIG. 14 is a schematic diagram illustrating another example of the gap retaining member 49 according to the first exemplary embodiment.

Further, according to the present exemplary embodiment, the gap retaining member is shaped as illustrated in FIG. 4. However, a cylindrical gap retaining member as illustrated in FIG. 14 may also be used. When there is a peripheral speed difference between the developing sleeve and the photosensitive drum in the portion in which the developing sleeve and the photosensitive drum opposing each other, friction is always generated against the photosensitive drum and/or the developing sleeve. The contact surface A with the photosensitive drum 1 and the contact surface B with the developing sleeve 41 of the gap retaining member 49 thus become abraded, and the S-D gap becomes narrow. In a process unit including such a gap retaining member, retention of the developer in the vicinity of the portion in which the developing sleeve and the photosensitive drum opposed to each other can also be prevented by performing similar control.

Furthermore, according to the present exemplary embodiment, the image forming apparatus employs the developing method in which the rotational directions of the developing sleeve and the photosensitive drum in the portion where the developing sleeve and the photosensitive drum are positioned opposing each other are in opposite directions. However, this is not a limitation. A similar effect can be achieved in an image forming apparatus employing a developing method in which the rotational directions of the developing sleeve and the photosensitive drum in the portion where the developing sleeve and the photosensitive drum are positioned opposing each other are in the same direction.

The second exemplary embodiment will be described below with reference to FIG. 15. According to the first exemplary embodiment, the gap retaining member 49 is formed of polyamide resin as a material. According to the present exemplary embodiment, the gap retaining member is formed of a resin member and a bearing. The other configurations are similar to those of the first exemplary embodiment, so that the same reference numerals are assigned to the same components, and description thereof will be omitted.

Figure 15:
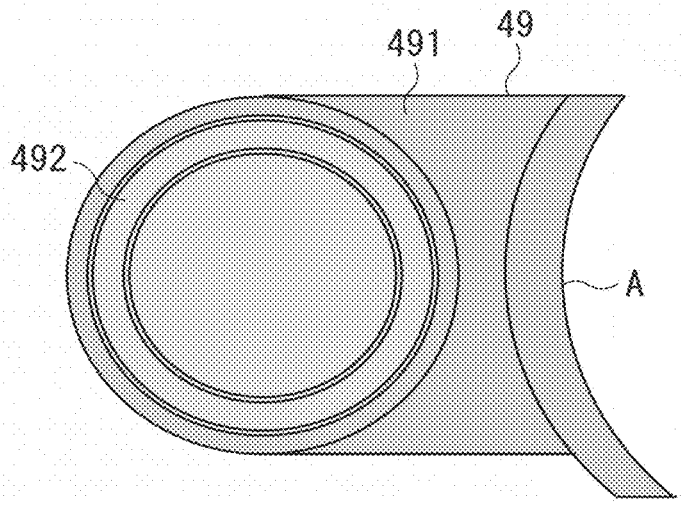
FIG. 15 is a schematic diagram illustrating the gap retaining member 49 according to a second exemplary embodiment.

FIG. 15 illustrates the gap retaining member 49 according to the second exemplary embodiment. Referring to FIG. 15, the gap retaining member 49 according to the present exemplary embodiment includes a resin member 491 and a bearing 492. The resin member 491 is formed of polyamide as a material, similarly as in the first exemplary embodiment. A curved surface A of the resin member 491 abuts on the photosensitive drum 1, and the end shaft of the developing sleeve 41 pass through the bearing 492. The gap retaining member 49 is thus pressed to abut on the photosensitive drum side from the developing sleeve side, and retains the S-D gap.

In such a gap retaining member, the curved surface A becomes abraded when the photosensitive drum 1 is driven, so that the S-D gap becomes narrow. However, since the abutting portion of the gap retaining member 49 on the developing sleeve 41 is the bearing 492, there is no abrasion even when the developing sleeve 41 is driven, and the S-D gap does not become narrow. According to the present exemplary embodiment, the abrasion amount Z of the gap retaining member is thus predicted as follows. The abrasion amount Z is predicted by dividing an increase in the drive time TD of the photosensitive drum in the main body operation by the drive time TD0 of the photosensitive drum for forming one sheet of an image, and multiplying by 10/30000 (μm/sheet).

The abrasion amount Z of the gap retaining member 49 is thus predicted as described above, and the fog removal potential and the contrast potential are controlled similarly as in the first exemplary embodiment. As a result, retention of the developer does not occur even when the gap retaining member is abraded due to performing a large number of image forming processes, and the S-D gap has become narrow. Further, the abrasion amount of the gap retaining member is small with respect to the number of sheets on which the images are formed, so that a longer life time is acquired.

The third exemplary embodiment will be described below with reference to FIG. 16. According to the first exemplary embodiment, the abrasion amount of the gap retaining member is predicted, and the fog removal potential Vback and the contrast potential Vcont are controlled when the abrasion amount becomes greater than or equal to a predetermined amount. In contrast, according to the present exemplary embodiment, a user is notified of replacing the image forming unit when the abrasion amount becomes greater than or equal to a predetermined value. As a result, control similar to the first exemplary embodiment is performed along with urging the user to replace the image forming unit. The other configurations are similar to those of the first exemplary embodiment, so that the same reference numerals are assigned to the same components, and description thereof will be omitted.

Figure 16:
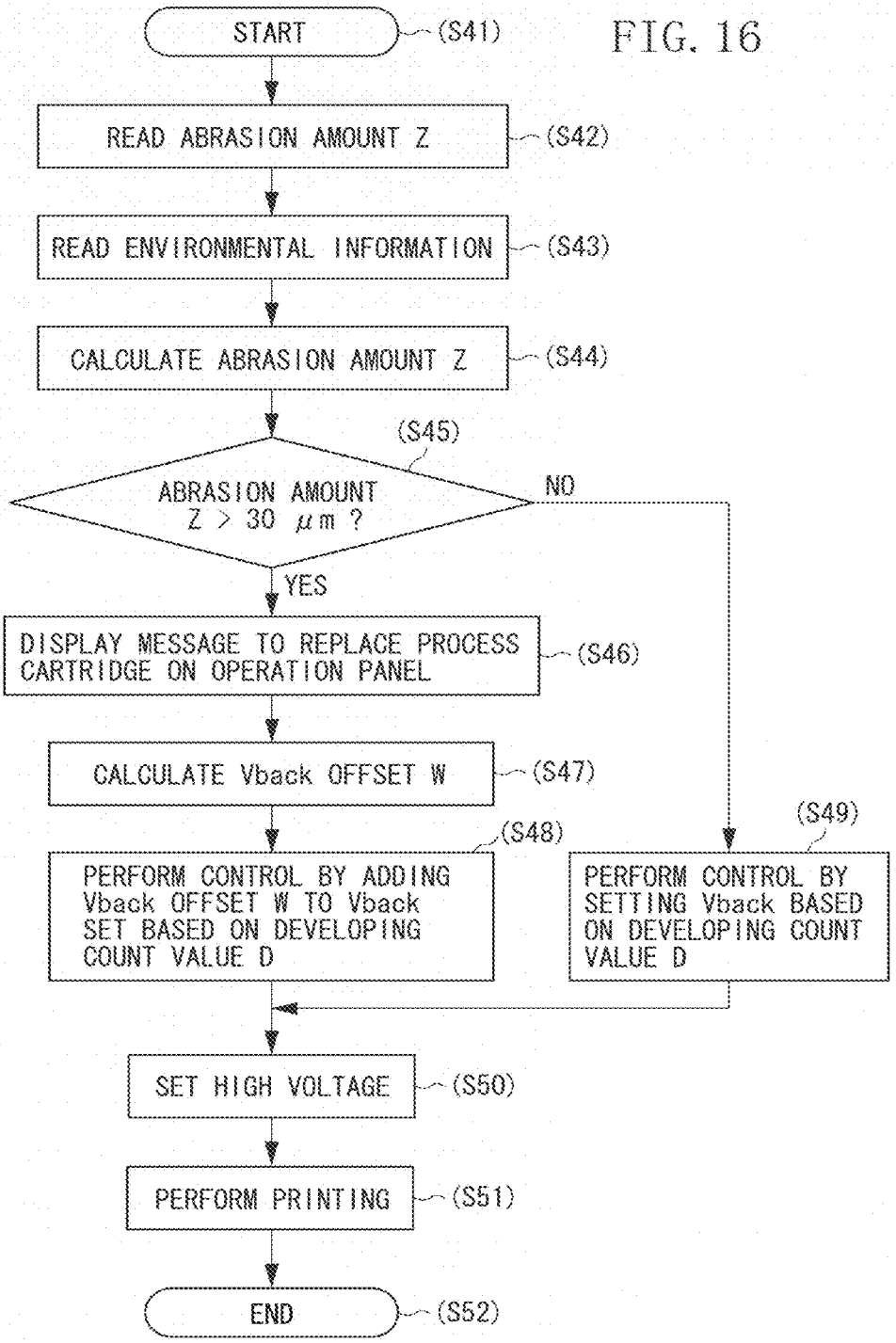
FIG. 16 is a flowchart illustrating a process for performing high-voltage control based on the abrasion amount of the gap retaining member according to a third exemplary embodiment.

FIG. 16 is a flowchart illustrating a process for performing high-voltage control according to the abrasion amount of the gap retaining member according to the present exemplary embodiment.

In step S41, the image forming apparatus starts to operate. In step S42, the CPU 61 reads from the back-up RAM 62 the abrasion amount Z of the gap retaining member before the current image forming process. In step S43, the environmental sensor 80 detects the temperature and the humidity of the area around the image forming apparatus. In step S44, the CPU 61 calculates the abrasion amount Z using the drive time TD of the photosensitive drum 1 and the drive time TS of the developing sleeve 41. In step S45, the CPU 61 determines whether the calculated abrasion amount Z is greater than 30 μm. If the CPU 61 determines that the calculated abrasion amount Z is greater than 30 μm (YES in step S45), the process proceeds to step S46. In step S46, the CPU 61 displays replacement timing of the process cartridge P on an operation panel of the image forming apparatus.

In step S47, the CPU 61 calculates the Vback offset W according to the abrasion amount. In step S48, the CPU 61 adds to the setting of the fog removal potential Vback as illustrated in FIG. 10, the Vback offset W according to the abrasion amount, based on the developing count value D and the environmental data. In step S50, the CPU 61 then determines and applies the high voltage setting based on the environmental table including the charging bias and the developing bias. In step S51, the image forming process is performed.

If the CPU 61 determines that the calculated abrasion amount Z is less than or equal to 30 μm (NO in step S45), the process proceeds to step S49. In step S49, the CPU 61 sets Vback based on the developing count value D as illustrated in FIG. 9. In step S50, the CPU 61 determines and applies the high voltage setting. In step S51, the image forming process is performed.

By performing the above-described control, the abrasion amount of the gap retaining member is predicted, and when the abrasion amount becomes greater than or equal to a predetermined value, a display urging the user to replace the process cartridge is performed on the operation panel. Further, retention of the developer does not occur by performing control of the fog removal potential and the contrast potential, even when the gap retaining member is abraded due to performing a large number of image forming processes, and the S-D gap has become narrow. Furthermore, retention of the developer is securely prevented by urging the user to replace the process cartridge, and having the user replace the process cartridge before further abrasion occurs.

Moreover, a similar effect may be achieved by performing similar control when using the gap retaining member according to the second exemplary embodiment and calculating the abrasion amount based on the drive time of the photosensitive drum.

Further, according to the present exemplary embodiment, the process cartridge P including the photosensitive drum and the developing device is detachably-attached to the image forming apparatus 100. However, a similar effect may be acquired using the developing device 4 including the gap retaining member which is detachably-attached to the image forming apparatus 100, and urging the user to replace the developing device 4.

The fourth exemplary embodiment will be described below with reference to FIG. 17. According to the first exemplary embodiment, the abrasion amount of the gap retaining member is predicted, and the fog removal potential and the contrast potential are controlled when the abrasion amount becomes greater than or equal to a predetermined amount. In contrast, according to the present exemplary embodiment, the image forming process performed by the image forming apparatus is stopped when the abrasion amount becomes greater than or equal to a predetermined value. The user is then notified of replacing the process cartridge. The other configurations are similar to those of the first exemplary embodiment, so that the same reference numerals are assigned to the same components, and description thereof will be omitted.

Figure 17:
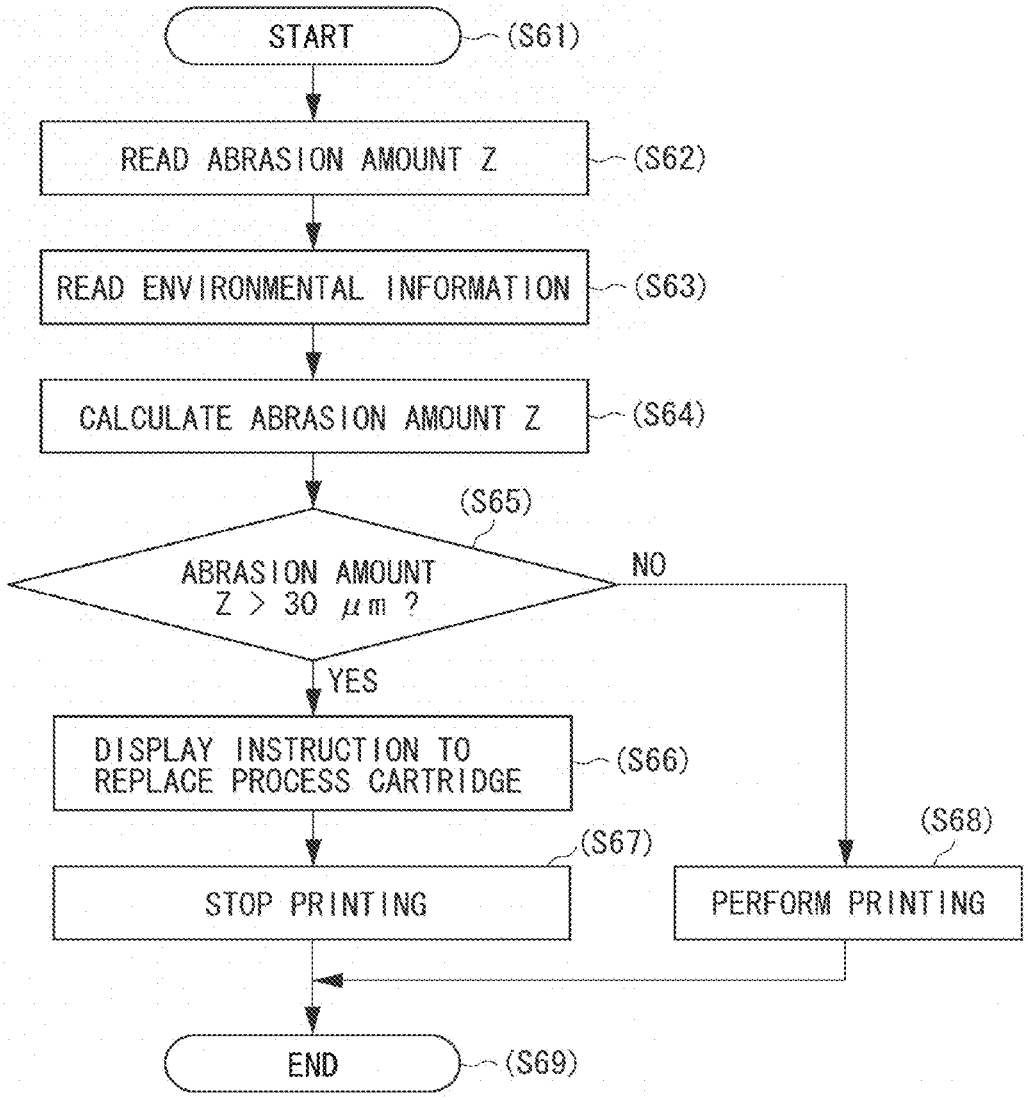
FIG. 17 is a flowchart illustrating a process for instructing replacement of a process cartridge based on the abrasion amount of the gap retaining member according to a fourth exemplary embodiment.

FIG. 17 is a flowchart illustrating a process for instructing the user to replace the process cartridges Pa, Pb, Pc, and Pd based on the abrasion amount of the gap retaining member according to the present exemplary embodiment.

In step S61, the image forming apparatus starts to operate. In step S62, the CPU 61 reads from the back-up RAM 62 the abrasion amount Z of the gap retaining member before the current image forming process. In step S63, the environmental sensor 80 detects the temperature and the humidity of the area around the image forming apparatus. In step S64, the CPU 61 calculates the abrasion amount Z using the drive time TD of the photosensitive drum 1 and the drive time TS of the developing sleeve 41. In step S65, the CPU 61 determines whether the calculated abrasion amount Z is greater than 30 μm. If the CPU 61 determines that the calculated abrasion amount Z is greater than 30 μm (YES in step S65), the process proceeds to step S66.

In step S66, the CPU 61 displays on the operation panel in the image forming apparatus an instruction to replace the process cartridge P. In step S67, the CPU 61 stops the image forming process performed in the image forming apparatus 100, and stops receiving image forming processing instructions. On the other hand, if the CPU 61 determines that the calculated abrasion amount Z is less than or equal to 30 μm (NO in step S65), the process proceeds to step S69. In step S69, the image forming process is performed.

By performing the above-described control, the abrasion amount of the gap retaining member is predicted. When the abrasion amount becomes greater than or equal to a predetermined value, the image forming process is stopped, and the instruction to replace the process cartridge is displayed on the operation panel. As a result, the user replaces the process cartridge so that the retention of the developer is firmly prevented.

Moreover, a similar effect may be achieved by performing similar control when using the gap retaining member according to the second exemplary embodiment and calculating the abrasion amount based on the drive time of the photosensitive drum.

Further, according to the present exemplary embodiment, the process cartridge P including the photosensitive drum and the developing device is detachably-attached to the image forming apparatus 100. However, a similar effect may be acquired using the developing device 4 including the gap retaining member which is detachably-attached to the image forming apparatus 100, and urging the user to replace the developing device 4.

According to the present invention, an image forming apparatus is capable of reducing failure caused by retention of the developer in the area where the developing sleeve and the photosensitive drum are positioned opposing each other. Such retention of the developer occurs due to abrasion of the gap retaining member which retains the gap between the developer bearing member and the image bearing member by abutting on the image bearing member.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-247861 filed Nov. 4, 2010, which is hereby incorporated by reference herein in its entirety.

What is claimed is:

1. An image forming apparatus comprising:

an image bearing member;

a developing device configured to develop a latent image formed on the image bearing member, wherein the developing device carries developer including a toner and a magnetic carrier, the developing device comprising:

a developer bearing member that is rotatably provided; and a magnet provided inside the developer bearing member, configured to make a developer be carried on a surface of the developer bearing member;

a gap retaining member contacting with each of the image bearing member and the developer bearing member, configured to retain a distance between the image bearing member and the developer bearing member; and a control unit configured to control a potential difference between a potential of a non-image portion of the image bearing member and a DC developing bias applied to the developer bearing member, wherein the control unit executes a mode to decrease the potential difference based on a first information about integration of a driving amount of the image bearing member and a second information about integration of a driving amount of the developer bearing member.

2. The image forming apparatus according to claim 1, wherein the control unit is configured to execute the mode in a case where a value calculated from the first information and the second information from when the developing device is initially installed or the developing device is replaced is larger than a predetermined value.

* * * * *